United States Patent [19]

Kaspaul

[11] 4,244,703

[45] Jan. 13, 1981

[54] FUEL ADDITIVES

[75] Inventor: Alfred F. Kaspaul, Malibu, Calif.

[73] Assignee: California-Texas Oil Company, Glendale, Calif.

[21] Appl. No.: 7,305

[22] Filed: Jan. 29, 1979

[51] Int. Cl.[3] ..... C10L 1/18; C10L 1/22

[52] U.S. Cl. ..... 44/56; 44/53; 44/72; 44/68; 44/77

[58] Field of Search ..... 44/53, 56, 72, 67, 68, 44/77

[56] References Cited

U.S. PATENT DOCUMENTS

| | | | |
|---|---|---|---|
| 2,637,635 | 5/1953 | McLaughlin et al. | 44/53 |
| 2,891,850 | 6/1959 | Cosgrove et al. | 44/72 |
| 2,961,309 | 11/1960 | Moore | 44/72 |
| 3,523,769 | 8/1970 | Tooke | 44/72 |
| 3,705,024 | 12/1972 | Zimmerman et al. | 44/72 |
| 3,817,720 | 6/1974 | Moy et al. | 44/56 |

*Primary Examiner*—Jacqueline V. Howard
*Attorney, Agent, or Firm*—Kenneth E. Darnell

[57] ABSTRACT

A family of fuel additives particularly containing certain diamines preferably in combination with certain alcohols, the invention provides compositions of matter which improve the performance of internal combustion engines and provide favorable fuel economies relative to fuels not used with the present additives. Tertiary diamines such as N,N,N',N'-tetramethyl-1,3-propanediamine are added in low concentrations to gasoline, the diamines preferably being mixed with an anhydrous alcohol prior to admixture with gasoline. Particularly effective additives according to the invention also include an admixture of the foresaid mixture with isopropyl and diacetone alcohols.

27 Claims, No Drawings

FUEL ADDITIVES

BACKGROUND OF THE INVENTION

1. Field of the Invention

The invention generally relates to the field of fuel additive compositions and particularly to fuel additive compositions capable of increasing the thermal efficiency of internal combustion engines, thereby to increase fuel economy.

2. Description of the Prior Art

Fuel additives have long been employed to provide a variety of functions in fuels intended for consumption in internal combustion engines, these functions ranging from cleaning to anti-icing and from anti-knock to bacterial growth inhibition. Such additives, which may either be introduced at the refinery or directly into a fuel tank essentially at the use site, have little effect on the thermal efficiency of an engine, a not so surprising situation since the heat value of a fuel cannot reasonably be expected to increase due to the introduction of an additive which is present in a concentration of only a few percent. While certain additives available on the market promise fuel economy, it has not been shown that substantial economies are realized through the use of the presently available additives. Exhaustive testing has shown that the average thermal efficiency of present internal combustion engines seldom exceeds 10% and varies little when fuel additives are present in the fuel. An unfortunate but unavoidable fact thus presents itself, that is, the average internal combustion engine such as in use in the average vehicle must burn nearly 10 gallons of fuel in order to extract the work equivalent actually present in only one gallon of fuel. The work equivalent in nearly nine gallons of fuel is simply lost or "wasted" in the conversion process, a waste which not only directly contaminates the environment, but which also increases its entropy.

While pollution control measures have come into use in automotive vehicles by legislative demand, such measures require the burning of even greater quantities of fuel in order to reduce environmental pollution. Recent fuel efficiency increases which accompanied these pollution control measures have not been due to improvements in combustion efficiency, but to reductions in the weight of vehicles. Specific fuel consumption, thus fuel economy, is improved with increases in compression ratio; however, present automotive engines must be operated at relatively low compression ratios and also must drive the devices which effect pollution control, thus further decreasing fuel economy.

Additives such as are described by Coffield in U.S. Pat. No. 3,318,812 are primarily intended to reduce emissions in internal combustion engines, those fuel additives described by Rosenwald in U.S. Pat. No. 3,756,795 actively reduce icing while Niebylski et al in U.S. Pat. No. 4,005,992 provide anti-knock fuel additives. The additives referred to above, as well as the anti-bacterial fuel additives of Cadorette et al disclosed in U.S. Pat. No. 3,719,458 are comprised of alcohols or amines, the compositions having no affect on the combustion efficiency of an engine.

The present fuel additives specifically intend to increase thermal efficiency by improving the combustion characteristics of an engine in which a given fuel is burned. The present additives improve fuel vaporization and distribution as well as post-combustion conditions in the engine, thereby providing improvements in the combustion process itself and thus the fuel economy in the engine.

SUMMARY OF THE INVENTION

The present invention provides fuel additives which improve the combustion process in internal combustion engines. A particular use of the present fuel additives is for the improvement of fuel economy in vehicles which use internal combustion engines. The present fuel additives can be seen to improve air/fuel distribution prior to and during combustion, the fuel being particularly better vaporized prior to combustion due to the action of the present additives. Due primarily to the improved combustion provided by the present additives, pollutants emanating from an engine which is burning a fuel-/additive mixture according to the invention are reduced in quantity and are of a less noxious composition than would be the case if the engine were burning the fuel alone.

The octane ratings of fuels are also increased by the use of the present additives, thereby allowing the utilization of efficient high compression engines which need not be burdened with a plurality of energy-wasteful pollution control devices in order to reduce polluting emissions.

The present additives also cause certain post-combustion reactions to occur which increase combustion efficiency. Combustion knock and wear are further reduced due to use of the present additives.

The accomplishment of the above-noted functions constitute at least in part the objects of the present invention, the invention itself comprising the novel fuel additives which are hereinafter described in detail. Further objects and advantages of the invention will be apparent in light of the following description of the preferred embodiments of the invention.

DESCRIPTION OF THE PREFERRED EMBODIMENTS

The family of fuel additives provided by the present invention have as a primary component a diamine, particularly a tertiary diamine, which can be added to the fuel at the refinery or directly in the fuel tank. It is further possible to meter the present additives into the combustion air on mixing with the fuel immediately prior to combustion. The diamines useful according to the invention are preferably mixed with alcohols, particularly anhydrous ethanol, isopropyl alcohol and diacetone alcohol. The tertiary diamines of the invention can be represented by the general formula

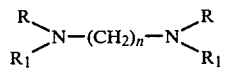

in which R is an alkyl group and particularly a methyl group; wherein $R_1$ is hydrogen or an alkyl group and particularly methyl; and wherein n is an integer between 1 and 6.

The tertiary diamine preferred according to the invention is known both as tetramethyldiaminepropane and a N,N,N',N'-tetramethyl-1,3-propanediamine. While the tertiary diamines of the invention can be used per se as fuel additives, it is preferred that the diamines be mixed with an anhydrous alcohol, particularly ethanol, prior to admixture with the fuel. A one to one ratio by weight is preferred. The diamine/anhydrous alcohol mixture can further be admixed with a substantially one to one mixture of isopropyl alcohol and diacetone alcohol, the diamine being preferably present in the resulting admixture in a concentration which is approximately 10% of the concentration of either the isopropyl alcohol or the diacetone alcohol. The admixture of the diamine, anhydrous alcohol, isopropyl alcohol, and diacetone alcohol is a preferred additive according to the invention, this preferred additive being admixed with a fuel such as gasoline in a preferred concentration range of between 0.5 and 4.0 ml. of diamine to 20 gallons of fuel.

During make-up of the preferred additive, the diamine is fixed mixed with an equal part of anhydrous ethanol, the diamine/ethanol mixture then being added to an equal parts mixture of isopropyl alcohol and diacetone alcohol. The ratio of the diamine/ethanol mixture to the isopropyl alcohol/diacetone alcohol mixture is preferably between 0.5 to 0.025. It should be understood that the diamine/anhydrous alcohol, preferably ethanol, mixture can be used directly as a fuel additive according to the invention. The ratio of additive to gasoline can also be expressed based on the diamine content as $10^{-4}$ when the diamine is only admixed with an anhydrous alcohol and as $10^{-3}$ when the additive also comprises isopropyl alcohol and diacetone alcohol.

The present additives may be mixed with fuel in bulk either at the refinery, at a distribution center, or at a point of sale. The present additives can also be mixed with fuel in a "gas tank" of a vehicle by the operator of the vehicle. It is further contemplated that the present additives can be metered into the carburetor fuel or induction air from a rechargeable reservoir. The additives could also be metered into induction air via an active air filter.

Precombustion reactions which produce free radicals have a pronounced affect on the combustion process including the emissions produced by the process. According to the invention, the diamines employed as active constituents of the present fuel additives have substantial affects of these precombustion reactions.

The invention further contemplates the substitution of all or part of the diamine described above with metal-diamines, particularly zinc-diamines. Particular examples are N,N,N',N'-tetramethylzinc-1,4-butanediamine, N,N,N',N'-tetramethylzinc-1,3-propanediamine, N,N,N',N'-tetramethylzinc-1,2-ethanediamine, and N,N,N',N'-tetramethylzinc-1,1-methanediamine. These metal-diamines particularly modify the combustion process itself. The tertiary diamine can be present relative to the metal diamine in a ratio of from 0 to 0.5.

The present additives also reduce "knock" in engines caused by the relatively slow oxidation of the "end gas" prior to arrival of the flame front, such conditions resulting in detonation in the combustion chamber on sudden contact between the end-gas and the flame front. Friction and wear in internal combustion engines is also reduced through use of the present fuel additives. Since the present additives also actively reduce pollution in exhaust effluents, a return to more efficient high compression engines will be possible.

The efficacy of the present fuel additives can be seen by way of the following examples:

EXAMPLE I

Equal amounts of tetramethyldiaminopropane and anhydrous ethanol were mixed in a suitable glass container. The pre-mix was added to one liter of Chevron Regular and thoroughly stirred. The mixture was further diluted with gasoline to obtain an amine concentration of 0.4 ml/l. The gasoline was estimated to have a caloric value of 110,000 BTU/gallon. Utilizing a Sears power plant of 1700 watts, a resistive load of 1400 watts, and 500 ml of gasoline for each test run, the following results were obtained; Runs 1–6 being with the additive/fuel mixture and Runs 7–12 being with only the gasoline:

| Run # | Time Spread | W.sec/1 ($\times 10^{-6}$) | Thermal Efficiency |
|---|---|---|---|
| 1–6 (Additive) | 1199–1150 $\Delta t$ = 49 sec | 3.26 | 10.6% |
| 7–12 (No Additive) | 1181–935 $\Delta t$ = 246 sec. | 2.90 | 9.4% |

The calculated efficiencies assume an energy value of 43 MJ/kg of gasoline.

EXAMPLE II

Equal amounts of tetramethyldiaminopropane and anhydrous ethanol were mixed in a suitable glass container. The mixture was added to one liter of Chevron Regular and thoroughly stirred. This additive/gasoline mixture was further diluted with gasoline to obtain an amine concentration of about 0.053 ml/l. Utilizing a passenger car, a Buick Skylark '71 two door coupe, hard top, engine 350-4, bore 3.8, stroke 3.85, compression ratio 8.5/1, displacement 350, and A/C at full power with two passengers, the following results were obtained while driving a typical mix of freeway links and city roads:

| SUCCESSIVE TRIP #'s | ADDITIVE | MPG |
|---|---|---|
| 1 | None | 15.0 |
| 2 | Yes (4 ml/20 gallons) | 17.6 |
| 3 | estimated residual CT-024 (<2 ml/20 gallons) | 16.8 |
| 4 | estimated residual CT-024 (<1 ml/20 gallons) | 16.7 |
| 5 | estimated residual CT-024 (<0.5 ml/20 gallons) | 15.2 |

As can be seen from the results obtained in Example II, the use of the present additives produces a "memory effect" in the engine which lasts for a period of time, even though fuel without the additives is being introduced into the fuel supply. It is further observed in road tests of the type described in Example II that the present additives have the ability to reduce or suppress engine knock in cars which require unleaded gasoline for low compression engines fitted with catalytic converters. Under heavy load conditions, such cars experience engine knock even though the engines are designed to operate on unleaded fuel. Additive concentrations much less than those required for tetraethyl lead completely eliminate engine knock in such engines and provide smooth operating propulsion performance.

EXAMPLE III

A number of road tests utilizing a variety of vehicles and test tracks were conducted and are summarized as follows, an additive comprised of 1:1 tetramethyldiaminemethane and anhydrous alcohol being used at a concentration of 4 ml/20 gallons of gasoline:

| VEHICLE | TRACK | IMPROVEMENT |
|---|---|---|
| Lincoln Continental Town Coupe, 1977 | Miscellaneous and Solvang Runs | 4% |
| Lincoln Continental | Miscellaneous and Solvang Runs | 7% |
| Oldsmobile Cutlass 1968 | Westlake Village Santa Monica Westlake Village | 20% |
| Buick Skylark 1971 | Malibu West Solvang Malibu West | 12% |

The Oldsmobile was used for commuting and was operated mostly on fast moving surface streets and freeways. Fuel economy improved each time the additive was added to a full tank of gasoline, the first time at 105,000 miles, 6%; second time at 113,400 miles, 8.2%; third time at 118,300 miles, 24%; then a steady 20%. Without the additive, fuel economy was around 15 MPG from 105,000 miles to about 120,000 miles.

It is seen from the foregoing that family of fuel additives is provided which increases the thermal efficiency of gasoline-operated engines, fuel economy and emission control being particularly increased. It should be understood, however, that the invention is not to be limited to the explicit showings hereinabove provided, but is to be interpreted by the scope of the appended claims.

What is claimed is:

1. A fuel composition having increased combustion efficiency and fuel economy, the composition comprising a mixture of hydrocarbons and containing a tertiary diamine having the formula:

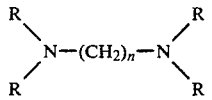

in which R is a methyl group and wherein n is an integer between 1 and 6, the diamine being present in the fuel composition in an effective amount, the composition further comprising an effective amount of an anhydrous alcohol.

2. A method for improving the combustion efficiency and fuel economy of an internal combustion engine, comprising the step of operating the engine with a fuel composition comprising a mixture of hydrocarbons and containing an effective amount of a tertiary diamine having the formula:

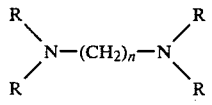

in which R is a methyl group and wherein n is an integer between 1 and 6, the fuel composition further comprising an effective amount of an anhydrous alcohol.

3. The composition of claim 1 wherein the alcohol is ethanol.

4. The composition of claim 1 and further comprising effective amounts of isopropyl alcohol and diacetone alcohol.

5. The composition of claim 1 wherein the diamine is present in a concentration range of between 0.5 and 4.0 milliliters of diamine to 20 gallons of hydrocarbon component.

6. The composition of claim 4 wherein the ratio of diamine/anhydrous alcohol to isopropyl alcohol/diacetone alcohol is between 0.5 to 0.025, the diamine being present in the fuel composition in a concentration range of between 0.5 to 4.0 milliliters of diamine to 20 gallons of hydrocarbon component.

7. The composition of claim 1 wherein n is 3.

8. The composition of claim 1 wherein n is 1.

9. The method of claim 2 wherein the anhydrous alcohol is ethanol.

10. The method of claim 2 wherein n is 3.

11. The method of claim 2 wherein n is 1.

12. The method of claim 9 wherein n is 3.

13. The method of claim 9 wherein n is 1.

14. The method of claim 2 wherein the fuel composition further comprises an effective amount of isopropyl alcohol and diacetone alcohol.

15. The method of claim 14 wherein the anhydrous alcohol is ethanol.

16. The method of claim 14 wherein the ratio of diamine/anhydrous alcohol to isopropyl alcohol/diacetone alcohol is between 0.5 to 0.025, the diamine being present in the fuel composition in a concentration range of between 0.5 to 4.0 milliliters of diamine to 20 gallons of hydrocarbon component.

17. A fuel composition having increased combustion efficiency and fuel economy, the composition comprising a mixture of hydrocarbons and containing an effective amount of a tertiary diamine having the formula:

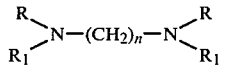

in which R and $R_1$ are alkyl groups and wherein n is an integer between 1 and 6, and a metal-diamine selected from the group consisting of N,N,N',N'-tetramethylzinc-1,4-butane diamine; N,N,N',N'-tetramethylzinc-1,3-propane diamine; N,N,N',N'-tetramethylzinc-1,2-ethane diamine; and N,N,N',N'-tetramethylzinc-1,1-methane diamine, the tertiary diamine being present relative to the metal diamine in a ratio of from 0 to 0.5.

18. A fuel composition having increased combustion efficiency and fuel economy, the composition comprising a mixture of hydrocarbons and containing an effective amount of a diamine having the formula:

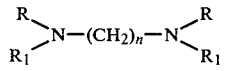

in which R is an alkyl group, $R_1$ is hydrogen or an alkyl group, and wherein n is an integer between 1 and 6, the fuel composition further comprising effective amounts of an anhydrous alcohol, isopropyl alcohol and diacetone alcohol.

19. The fuel composition of claim 18 wherein the anhydrous alcohol is ethanol.

20. The fuel composition of claim 18 wherein the ratio of diamine/anhydrous alcohol to isopropyl alcohol/diacetone alcohol is between 0.5 to 0.025, the diamine being present in the fuel composition in a concentration range of between 0.5 to 4.0 milliliters of diamine to 20 gallons of hydrocarbon component.

21. The fuel composition of claim 20 wherein the anhydrous alcohol is ethanol.

22. The fuel composition of claim 21 wherein R and $R_1$ are methyl groups.

23. The fuel composition of claim 22 wherein n is 3.

24. The fuel composition of claim 22 wherein n is 1.

25. The fuel composition of claim 18 wherein R and $R_1$ are methyl groups.

26. The fuel composition of claim 25 wherein n is 3.

27. The fuel composition of claim 25 wherein n is 1.

* * * * *